United States Patent [19]

Yamato et al.

[11] Patent Number: 4,754,736

[45] Date of Patent: Jul. 5, 1988

[54] METHOD OF CONTROLLING THE FUEL SUPPLY TO INTERNAL COMBUSTION ENGINES AT ACCELERATION

[75] Inventors: Akihiro Yamato; Fumio Yatabe, both of Utsunomiya, Japan

[73] Assignee: Honda Giken Kogyo K.K., Tokyo, Japan

[21] Appl. No.: 77,075

[22] Filed: Jul. 24, 1987

Related U.S. Application Data

[63] Continuation of Ser. No. 843,986, Mar. 25, 1986, abandoned.

[30] Foreign Application Priority Data

Mar. 27, 1985 [JP] Japan ..... 60-62539

[51] Int. Cl.[4] ..... F02D 5/02

[52] U.S. Cl. ..... 123/492; 364/431.07

[58] Field of Search ..... 123/492, 493; 364/431.07

[56] References Cited

U.S. PATENT DOCUMENTS

| | | | |
|---|---|---|---|
| 4,508,084 | 4/1985 | Yamato et al. | 123/492 |
| 4,508,086 | 4/1985 | Ito et al. | 123/492 |
| 4,520,784 | 6/1985 | Isobe et al. | 123/492 |
| 4,562,814 | 1/1986 | Abo et al. | 123/492 |
| 4,582,037 | 4/1986 | Otsuka et al. | 123/492 |
| 4,590,564 | 5/1986 | Ishikawa et al. | 123/492 |
| 4,590,912 | 5/1986 | Atago | 123/492 |
| 4,597,370 | 7/1986 | Yasuoka et al. | 123/492 |

*Primary Examiner*—Raymond A. Nelli

*Attorney, Agent, or Firm*—Arthur L. Lessler

[57] ABSTRACT

A method of controlling the fuel supply to an internal combustion engine at acceleration, wherein a quantity of fuel to be supplied to said engine is increased by the use of a accelerating fuel increment set in response to at least the valve opening speed of a throttle valve arranged in an intake passage of the engine. The accelerating fuel increment is set in response to a parameter value representative of engine load as well as to the valve opening speed of the throttle valve, whereby the fuel quantity is increased by an amount optimal for the engine load, to improve accelerability and emission characteristics of the engine.

6 Claims, 4 Drawing Sheets

| |
|---|
| FIG. 2A |
| FIG. 2B |

| Tw | Ne | nACC / TABLE GROUP | nACC=0 | nACC=1 | nACC=2 | nACC=3 |
|---|---|---|---|---|---|---|
| Tw > TWACC | Ne ≤ NACC1 | TACC1 TABLE GROUP | (1.0) | (1.1) | (1.2) | (1.3) |
| | | TACC2 TABLE GROUP (FUEL CUT WAS MADE IN LAST LOOP) | (2.0) | (2.1) | (2.2) | (2.3) |
| | NACC2≥Ne>NACC1 | TACC3 TABLE GROUP | (3.0) | (3.1) | (3.2) | (3.3) |
| | | TACC4 TABLE GROUP (FUEL CUT WAS MADE IN LAST LOOP) | (4.0) | (i,j)=(4.1) | (4.2) | (4.3) |
| Tw ≤ TWACC | Ne ≤ NACC2 | TACC1 TABLE GROUP | (1.0) | (1.1) | (1.2) | (1.3) |
| | | TACC2 TABLE GROUP (FUEL CUT WAS MADE IN LAST LOOP) | (2.0) | (2.1) | (2.2) | (2.3) |

METHOD OF CONTROLLING THE FUEL SUPPLY TO INTERNAL COMBUSTION ENGINES AT ACCELERATION

This application is a continuation of application Ser. No. 843,986 filed Mar. 25, 1986, now abandoned.

BACKGROUND OF THE INVENTION

This invention relates to a method of controlling the fuel supply to internal combustion engines at acceleration, and more particularly to a method of this kind which increases the quantity of fuel to be injected into the engine at acceleration by an accelerating fuel increment which is set to a value optimal for the accelerating condition of the engine.

A fuel supply control method for internal combustion engines is known e.g. from Japanese Provisional Publication (Kokai) No. 60-3458, which is capable of preventing so-called accelerating shock at acceleration of the engine and also improving accelerability of the engine. According to this fuel supply control system, one table group is selected from predetermined table groups for determining the value of an accelerating fuel increment TACC in dependence on an operating condition in which the engine is operating, i.e. whether the engine is in a high speed operating region, whether the engine is in an accelerating condition immediately after termination of a fuel cut operation, whether the engine coolant temperature is in a low temperature region, etc. Then, a different table is selected from the aforementioned selected table groups in accordance with each pulsed of a control signal generated at each of predetermined crank angle positions of the engine after first detection of the accelerating condition of the engine, e.g. a signal indicative of the top dead center (TDC). Finally, a value of the accelerating fuel increment TACC is read out from the selected table in response to the opening speed of the throttle valve. Each table is set such that a value of the accelerating fuel increment initially read out is a large value for initial acceleration of the engine, and thereafter gradually decreased values are read out as further pulses of TDC signal are generated.

According to the above described conventional method, the accelerating increment TACC value in each selected table is always read out only in response to the opening speed $\Delta\theta$ of the throttle valve. In addition, the accelerating increment TACC is generally set at values as to be assumed when the throttle valve is opened to fully open position or the maximum opening degree. However, even though the opening speed of the throttle valve shows the same value, there can be various modes of opening the throttle valve according to respective different ways of driving the engine, e.g. a mode of opening the throttle valve from an almost fully closed position to a medium opening position, and a mode of opening the valve from an almost fully closed position to a fully opened position. Particularly, when the opening speed of the throttle valve shows a large value at the initial stage of acceleration and the throttle valve is opened only to a small or medium opening position, the accelerating increment TACC will be set to the same value as that for a high load condition of the engine although the engine is actually operating in a low or middle load condition. As a result, the mixture to be supplied to the engine becomes overrich, which can badly affect the emission characteristics of the engine and can often cause so-called after-fire.

SUMMARY OF THE INVENTION

It is the object of the invention to provide a fuel supply control method for internal combustion engines at acceleration, which is capable of setting the accelerating fuel increment TACC to a value optimal for accelerating condition of the engine and particularly load condition of the engine, to thereby improve the accelerability and prevent deterioration of the emission characteristics as well as occurrence of after-fire.

According to this invention, a method is provided for controlling the fuel supply to an internal combustion engine at acceleration, wherein a quantity of fuel to be supplied to the engine is increased by the use of an accelerating fuel increment set in responsive to at least the valve opening speed of a throttle valve arranged in an intake passage of the engine. The method comprises the steps of:

(1) detecting the value of a parameter representative of load on the engine when the engine is accelerating; and (2) setting the accelerating fuel increment in response to the parameter value detected at the step (1) as well as the valve opening speed of the throttle valve.

Preferably, the step (2) comprises setting the accelerating fuel increment to a smaller value as the detected parameter value shows a value indicative of smaller load on the engine, and to a larger value as the detected parameter value shows a value indicative of larger load on the engine.

Further preferably, the parameter representative of the engine load is absolute pressure within the intake passage downstream of the throttle valve.

The above and other objects, features and advantages of the invention will be more apparent from the ensuing detailed description taken in conjunction with the accompanying drawings.

DETAILED DESCRIPTION

An embodiment of the invention will now be described in detail with reference to the drawings.

Figure 1:
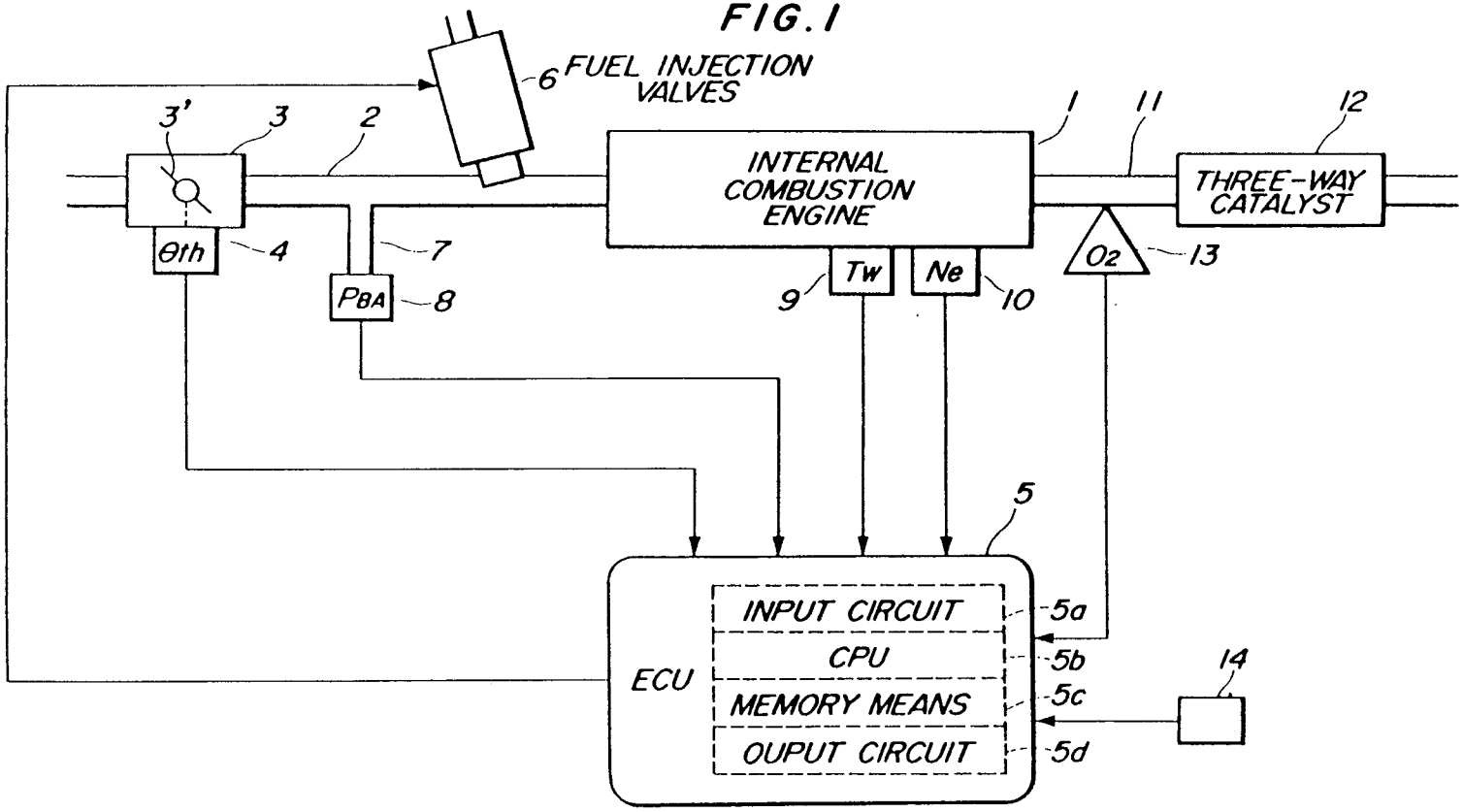
FIG. 1 shows a block diagram of the whole arrangemnet of a fuel supply control system to which is applied the method according to the present invention.

FIG. 1 shows the whole arrangement of a fuel supply control system to which is applied the method according to the invention. Reference numeral 1 designates an internal combustion engine which may be a four-cylinder type for instance, to which is connected an intake pipe 2. An intake pipe 2 is connected to the engine 1, in which is arranged a throttle valve 3 to which is connected a throttle valve opening ($\theta$th) sensor 4 for detecting its valve opening and converting same into an electrical signal which is supplied to an electronic control unit (hereinafter called "the ECU") 5.

Fuel injection valves 6 are arranged in the intake pipe 2 at a location between the engine 1 and the throttle valve 3, which correspond in number to the number of the engine cylinders and are each arranged at a location slightly upstream of an intake valve, not shown, of a corresponding engine cylinder. These injection valves 6 are connected to a fuel pump, not shown, and also electrically connected to the ECU 5 in a manner having their valve opening periods or fuel injection quantities controlled by signals supplied from the ECU 5.

On the other hand, an absolute pressure sensor (PBA sensor) 8 communicates through a conduit 7 with the interior of the intake pipe 2 at a location immediately downstream of the throttle valve 3. The absolute pressure sensor 8 is adapted to detect absolute pressure in the intake pipe 2 and supplies an electrical signal indicative of detected absolute pressure to the ECU 5.

An engine coolant temperature sensor 9, which may be formed of a thermistor or the like, is embedded in the peripheral wall of the engine cylinder block which is filled with engine coolant, an electric signal of which is supplied to the ECU 5.

An engine rotational speed (Ne) sensor 10 is arranged in facing relation to a camshaft or a crankshaft, not shown, of the engine and disposed to generate one pulse at a particular crank angle of the engine each time the engine crankshaft rotates through 180 degrees, that is, at a crank angle position before a predetermined crank angle with respect to the top-dead-center (TDC) position corresponding to the start of the suction stroke of each cylinder, as a TDC signal, which is supplied to the ECU 5.

A three-way catalyst 12 is arranged in an exhaust pipe 11 extending from the cylinder block of the engine 1 for purifying ingredients HC, CO and NOx contained in the exhaust gases. An $O_2$ sensor 13 is inserted in the exhaust pipe 11 at a location upstream of the three-way catalyst 12 for detecting the concentration of oxygen in the exhaust gases and supplying an electrical signal indicative of the detected concentration value to the ECU 5. Further connected to the ECU 5 are a sensor 14 for detecting atmospheric pressure and supplying an electrical signal indicative of detected atmospheric pressure to the ECU 5.

The ECU 5 comprises an input circuit **5*a* having functions such as waveform shaping and voltage level shifting for input signals from various sensors as aforementioned into a predetermined voltage value, and converting analog signals from some of the sensors to digital signals, a central processing unit 5*b* (hereinafter called "the CPU"), a storage means 5*c* for storing calculation programs executed by the CPU 5*b* and calculation results, and an output circuit 5*d* for supplying driving signals to the fuel injection valves 6**.

The ECU 5 operates in response to various engine operation parameter signals from various sensors as stated above, and in synchronism with generation of pulses of the TDC signal to determine operating conditions of the engine and calculate the fuel injection period TOUT of the fuel injection valves 6, which is given by the following equation, in accordance with the determined operating conditions of the engine :

$$TOUT = Ti \times K_1 \times TACC \times KACCLS \times K + K_3 \quad (1)$$

where Ti represents a basic value of the fuel injection period for the fuel injection valves 6, which has its value determined as a function of the engine rotational speed Ne and the intake pipe absolute pressure PBA. TACC a fuel increasing correction variable applied when the engine is accelerating, and KACCLS is a fuel decreasing correction coefficient applied when the engine is accelerating under a low load condition. TACC and KACCLS have their coefficients and correction values determined by a subroutine shown in FIG. 2, described hereinafter. $K_1$ and $K_2$, and $K_3$ are correction variables, respectively, which have their values calculated by the use of respective equations on the basis of the values of the engine operation parameter signals from the aforementioned various sensors so as to optimize the operating characteristics of the engine such as startability, emission characteristics, fuel consumption and accelerability.

The ECU 5 operates on the value of the fuel injection period TOUT determined as above to supply corresponding driving signals to the fuel injection valves 6 to drive same.

Figure 2A:
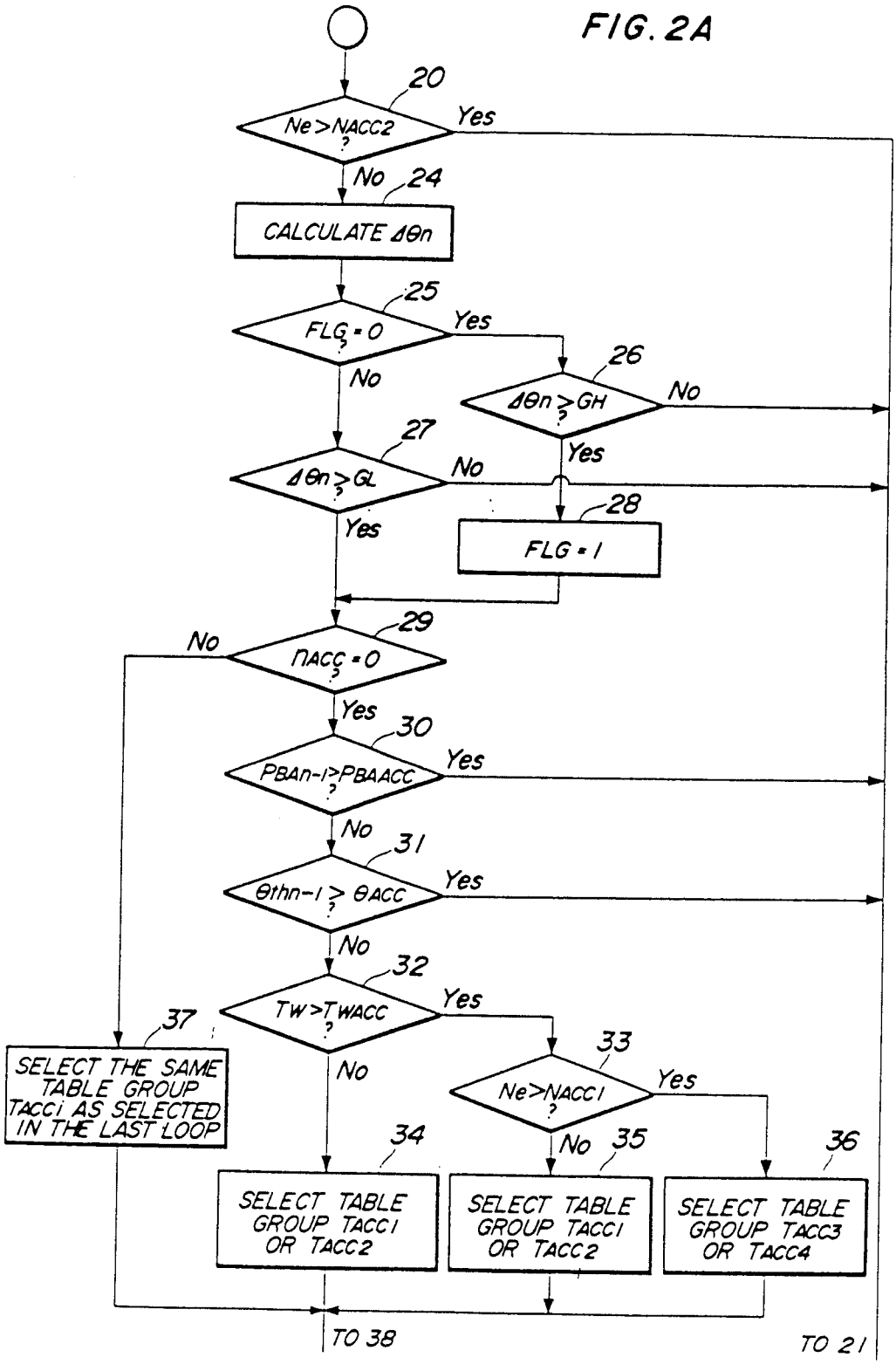
FIGS. 2, 2*a* and 2*b* are a flow chart showing a manner of setting the value of accelerating fuel increment TACC.
Figures 2, 2B:
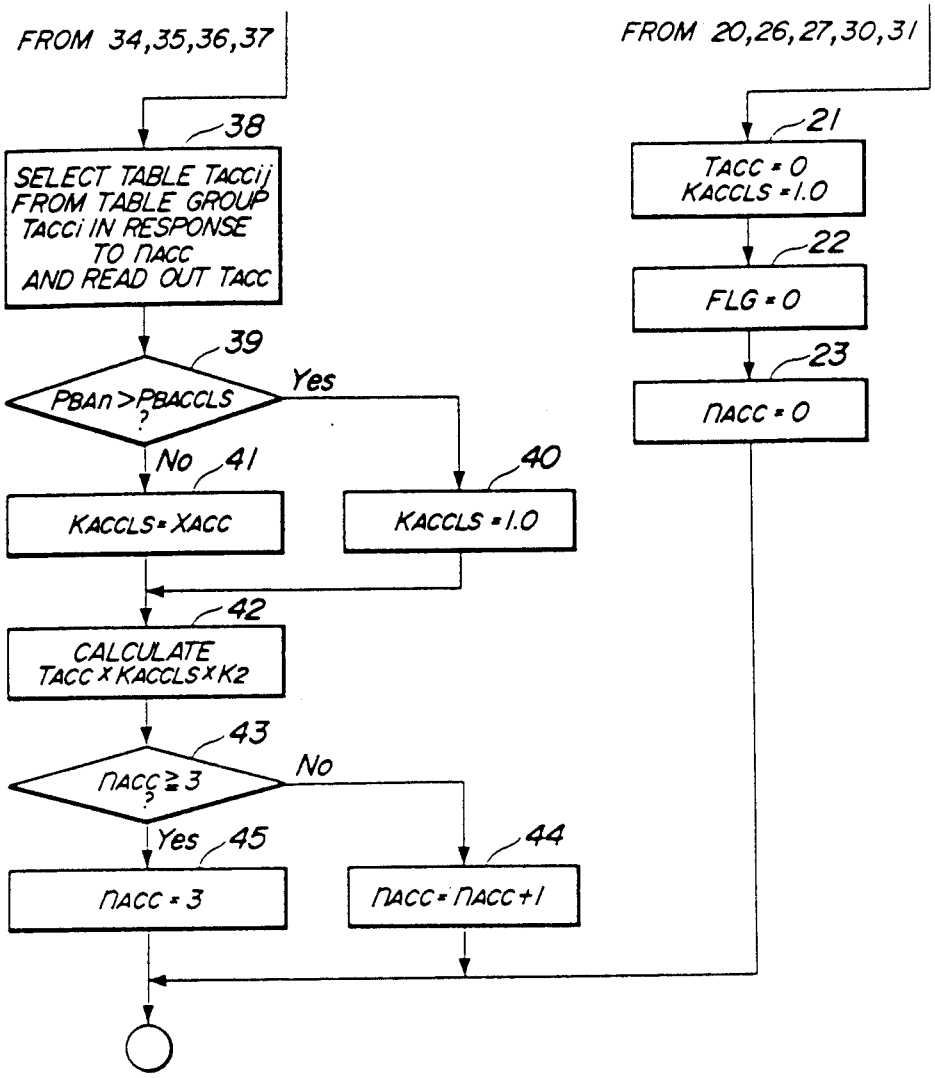

FIG. 2 shows a flowchart of the subroutine for determining the values of the correction variable TACC and correction coefficient KACCLS, which is executed by the CPU **5*b*** in synchronism with generation of pulses of the TDC signal.

First, at the step 20 in FIG. 2, it is determined whether or not the engine speed Ne is above a predetermined value NACC2 (e.g. 4000 rpm). This step is provided by the following reason: The so-called accelerating shock can occur only at acceleration of the engine from a low load operating condition, e.g. at acceleration from a decelerating condition wherein leaning of the mixture or a fuel cut operation is effected, or at acceleration from a low speed region of the engine. On the other hand, when the engine accelerates from a cruising condition in a high speed region, that is, from an engine speed above the above-mentioned predetermined value (4000 rpm), the accelerating shock usually does not occur. It is therefore not necessary to increase the fuel quantity for the acceleration in the latter case. Therefore, if the answer to the question of the step 20 is affirmative or yes, the value TACC is set to 0, and the fuel decreasing coefficient KACCLS according to the invention is set to 1.0, at the step 21, and a flag FLG and a control variable NACC, both described hereinafter, are both set to 0 at the steps 22 and 23, respectively, followed by terminating execution of the program.

When the answer to the question of the step 20 is negative or no, the program proceeds to the step 24, wherein an amount of variation of the valve opening $\theta$th of the throttle valve 3', that is, the valve opening speed $\Delta\theta$n is calculated by determining the difference $\Delta\theta n = \theta thn - \theta thn - 1$ between a valve opening value $\theta$thn detected at the time of generation of a present pulse of the TDC signal and a valve opening valve $\theta thn - 1$ detected at the time of generation of an immediately preceding pulse of the same signal. In lieu of the TDC signal, a clock signal having a constant pulse repetition period may be employed as the sampling signal for calculation of the throttle valve opening value $\theta$th in synchronism with generation of pulses thereof.

Then, it is determined at the step 25, whether or not the flag FLG value is 0, i.e. whether or not the engine was operating in an accelerating condition at the time of generation of the immediately preceding pulse of the TDC signal. If the answer is affirmative or yes, that is, if the engine was not in the accelerating condition in the last loop, the program proceeds to the step 26 to determine whether or not the valve opening speed $\Delta\theta$n calculated at the step 24 is larger than a first predetermined value $G_H$ for descriminating acceleration of the engine (e.g. 0.7 degrees per each time interval between adjacent pulses of the TDC signal).

If the answer to the question of the step 26 is negative or no, i.e. if the engine is not operating in the accelerating condition at the time of generation of the present pulse of the TDC signal, the program is terminated after executing the aforementioned steps 21 through 23.

On the other hand, if the answer to the question of the step 26 is affirmative or yes, that is, if the engine is operating in the accelerating condition, the program proceeds to the step 28 wherein the flag value FLG is set to 1. The step 28 is executed in order to memorize that the valve opening speed $\Delta\theta n$ exceeds the first predetermined value $G_H$ in the present loop, by storing the flag value FLG set to 1 into the memory means 5c.

Next, at the step 29, it is determined whether or not the value of a control variable $n_{ACC}$ is equal to zero. The control variable $n_{ACC}$, initially set at zero, is incremented by 1 at the step 44, as described hereinafter, each time the fuel quantity is corrected to an increased value while the engine is in the accelerating condition, and when it is determined at the step 43 that the value $n_{ACC}$ is three, the value $n_{ACC}$ is held at three thereafter in the case of four-cylinder engines. Therefore, if the answer to the question of the step 26 is affirmative or yes, it means that it is detected for the first time in the present loop that the engine is operating in the accelerating condition, since the control variable value $n_{ACC}$ is therefore zero in the present loop, the answer to the question of the step 29 is also affirmative or yes. Accordingly, the program executes the subsequent steps 30 and 31, wherein it is determined whether or not the engine was operating in a high load condition in the last loop. If the engine was in the high load condition in the last loop, the fuel quantity was corrected to an increased value so as to obtain a richer air/fuel ratio of the mixture in the last loop, by the use of a high load fuel increasing coefficient included in the correction coefficients K1 in the equation (1). On such an occasion, if the engine is detected to be in the accelerating condition in the present loop, it means that the engine is operating in the accelerating condition as well as in the high load condition in the present loop. Then, if no measures were taken, the fuel quantity were corrected to an increased value by not only the accelerating increment TACC but also the high load fuel increasing coefficient, resulting in an overrich air/fuel ratio of the mixture. To prevent this, the program is provided with steps 30, 31 for inhibiting correction of the fuel quantity by the use of the value TACC in the present loop when it is detected that the engine was operating in the high load condition in the last loop. To be specific, it is determined at the step 30 whether or not an intake pipe absolute pressure value PBAn-1 detected in the last loop and stored in the memory means 5c of the ECU 5 is above a predetermined value PBAACC (e.g. 360 mmHg), and at the step 31 whether or not a throttle valve opening $\theta thn-1$ detected in the last loop and stored in the memory means 5c is above a predetermined value $\theta$ACC (e.g. 30 degrees). If the answer to the question of either the step 30 or the step 31 is affirmative or yes, the program proceeds to the aforementioned step 21. If the answers to the questions of steps 30, 31 are both negative or no, the program then proceeds to the step 32.

Figure 3:
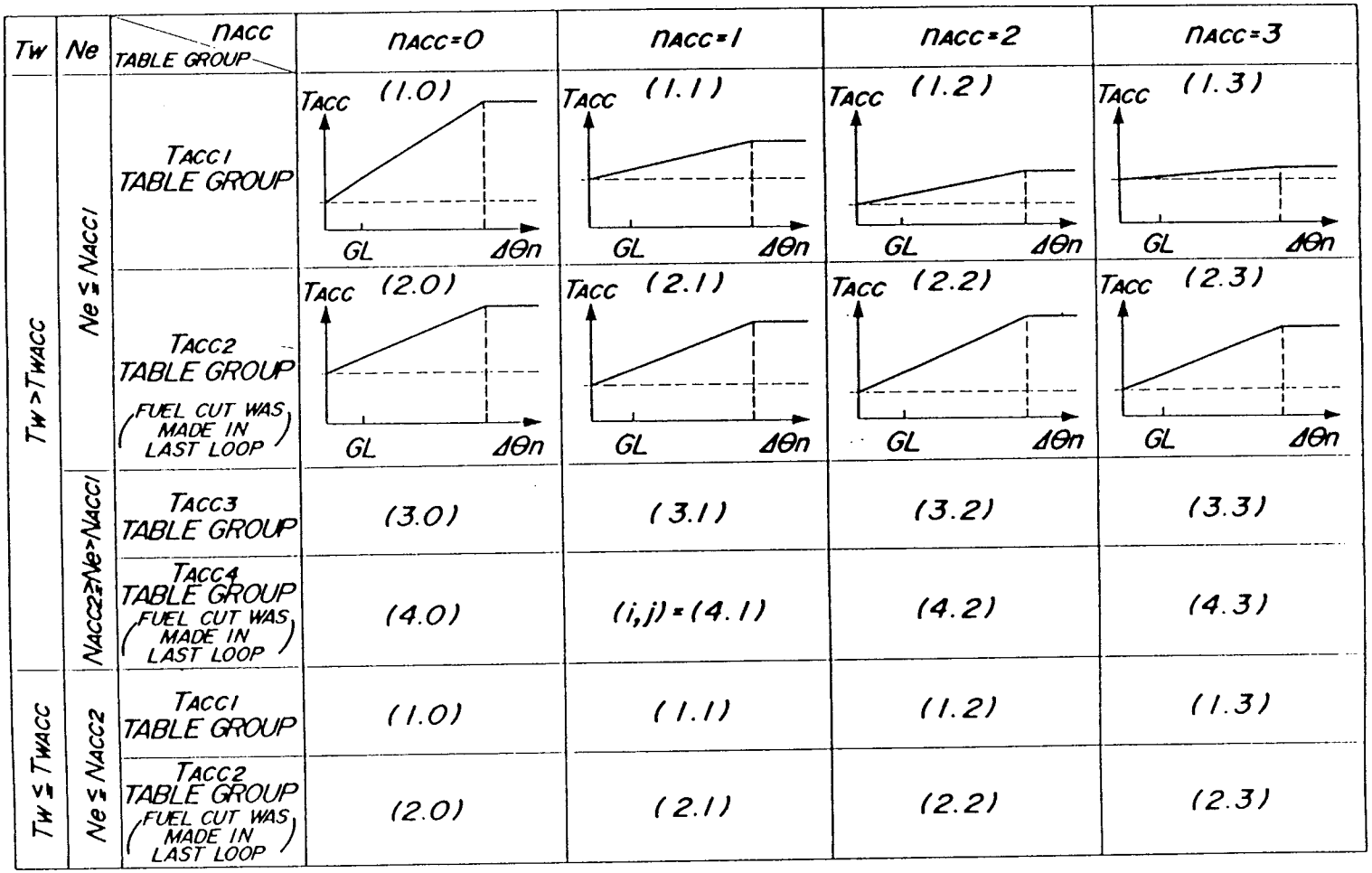
FIG. 3 is a graph showing groups of TACCi tables, which are selected in accordance with engine operating conditions.

At the steps 32 and subsequent steps 33 through 36, one of the table groups TACCi shown in FIG. 3 is selected in accordance with the engine operating conditions. First, at the step 32, a determination is made as to whether or not the engine coolant temperature TW is above a predetermined value TWACC (e.g. 80° C.). If the answer at the step 32 is negative or no, that is, if the engine coolant temperature is below the predetermined value TWACC, the program proceeds to the step 34 to select one table group from TACC1 and TACC2 table groups. The table groups TACC1 and TACC2, one of which is selected at the step 34, are the same table groups as those selected at the step 35, referred to hereinafter, when the value TW is above the predetermined value TWACC and at the same time the engine speed is below the predetermined value NACC1, as shown in FIG. 3. Each table group is composed of four TACCij tables. Specifically, the table group TACC2 is selected when the engine was operating in a fuel cut condition in the last loop and the present loop immediately follows termination of the fuel cut. Which of the two TACC1 and TACC2 table groups is to be selected is decided by determination steps, not shown.

If the answer to the question of the step 32 is affirmative or yes, the program proceeds to the step 33 wherein it is determined whether or not the engine speed Ne is above the predetermined engine speed NACC1 (e.g. 1500 rpm). If the answer at the step 33 is negative or no, the program proceeds to the step 35 wherein one table group is selected from the table groups TACC1 and TACC2 in the same manner as at the step 34. The table group TACC2, as described above, is selected when the engine was operating in the fuel cut condition in the last loop. If the answer to the question of the step 33 is affirmative or yes, the program proceeds to the step 36, wherein one table group is selected from table groups TACC3 and TACC4. The table group TACC4 is selected when the engine was operating in the fuel cut condition in the last loop.

Next, at the steps 34 through 36, a table TACCij is selected from the TACCi table group selected in accordance with operating conditions of the engine, in response to the control variable $n_{ACC}$. Then, the table TACCij is used at the step 38 to read out a value TACC therefrom in response to the valve opening speed $\Delta\theta n$ of the throttle value 3' determined at the step 24. The tables TACCij are set such that optimal TACC values are selected in accordance with operating conditions of the engine and the control variable $n_{ACC}$ value, as shown in FIG. 3, even though the valve opening speed $\Delta\theta n$ shows the same value. Furthermore, the values TACC to be determined from the tables TACCij in the table groups TACC3, TACC4 in FIG. 3 are set at optimal values to operating conditions of the engine in which the throttle valve 3' is opened almost to the maximum opening degree at acceleration of the engine, that is, the engine is operating in a high load condition wherein the intake pipe absolute pressure PBA is above a predetermined value PBACCLS which should prevail in the engine intake pipe if the throttle valve is opened to a degree close to the maximum opening degree of the throttle valve 3'.

Next, the program proceeds to the step 39, wherein it is determined whether or not the intake pipe absolute pressure PBAn is above a predetermined value PBACCLS (e.g. 160 mmHg), that is, whether or not the engine is accelerating in a low load condition. If the answer to the question of the step 39 is affirmative or yes, i.e. if the load on the engine at acceleration is not low, the fuel decreasing coefficient KACCLS value is set to 1.0 at the step 40, and then the program proceeds to the step 42. On the other hand, if the engine is accelerating in the low load condition, that is, if the answer at the step 39 is negative or no, the value KACCLS is set to a predetermined value XACC smaller than 1.0 (e.g. 0.63) at the step 41, and the program proceeds to the step 42. At the step 42, a final accelerating incremental value (TACC×KACCLS×K2) is obtained by multiplying the value TACC read out at the step 38 by the coefficient values KACCLS and K2, and then applied to the equation (1). When the fuel decreasing coefficient KACCLS is set to 1.0 at the step 40, it does not affect the calculated value (TACC×K2). However, if the coefficient value KACCLS is set to the predetermined value XACC smaller than 1.0 at the step 41, the accelerating increment value (TCC×K2) is corrected to a smaller value by being multiplied by the value XACC as the coefficient KACCLS.

Next, the program proceeds to the step 43 wherein it is determined whether the control variable $n_{ACC}$ is 3 or more. If the value $n_{ACC}$ is smaller than 3, that is, if the answer at the step 43 is negative or no, the value $n_{ACC}$ is incremented by one at the step 44. If the value $n_{ACC}$ is 3 or more, the value $n_{ACC}$ is held at 3 at the step 45, followed by termination of the present loop of the program.

When the next pulse of the TDC signal is generated, the next loop of the program of FIG. 2 is executed. Since the flag FLG was set to 1 at the step 28 in the last loop as noted before, the determination at the step 25 should be negative or no in the present loop, and then the program proceeds to the step 27, wherein a determination is made as to whether or not the valve opening speed $\Delta\theta n$ determined at the step 24 is above a second predetermined value $G_L$ (e.g 0.2 degrees per each time interval between adjacent TDC signal pulses) smaller than the first predetermined value $G_H$ applied at the step 26. By replacing the first predetermined value $G_H$ with the second predetermined value $G_L$ in the second step following the first step immediately after first detection of the engine accelerating condition, the system can exactly detect even such an accelerating condition wherein the valve opening speed $\Delta\theta n$ of the throttle valve 3' is initially large and thereafter gradually becomes smaller. If the answer to the question of the step 27 is affirmative or yes, the program proceeds to the step 29, wherein it is determined whether or not the control variable $n_{ACC}$ is equal to zero. In the present loop, the determination in the step 29 should be negative or no because the control variable $n_{ACC}$ has been incremented by one at the step 44 in the last loop as noted before. Then, the program proceeds to the step 37, wherein the same table group TACCLi as the one selected at one of the steps 34, 35, 36 in the last loop is selected again, and the steps 38 and subsequent steps are executed thereafter.

So long as the engine speed Ne is below the predetermined value NACC2 (i.e. the answer at the step 20 is negative) and the valve opening speed $\Delta\theta n$ of the throttle valve 3' is above the second predetermined value $G_L$, the program continually executes the step 37 and subsequent steps 38, etc, to thereby continue the correction of the fuel quantity to increased values at engine acceleration.

On the other hand, if the answer to the question of the step 27 is negative or no, that is, if the acceleration of the engine was detected in the last loop, but not in the present loop, the program is terminated after executing the steps 21 through 23.

The manner of setting the value of the fuel decreasing coefficient KACCLS is not limited to one employed in the foregoing embodiment, but the value KACCLS may vary in a continuous manner in response to the intake pipe absolute pressure PBA.

In the above described embodiment, the TACC values read out from each table TACCij in the selected one table group TACCi are set at values optimal for a high load operating condition to be assumed by the engine. However, they may be set at values optimal for a low load operating condition to be assumed by the engine. With such an alternative setting of the TACC values, the value KACCLS may be set to 1.0 at the step 41 and a predetermined value XACC' (e.g. 2.0) larger than 1.0 at the step 40, to thereby obtain the same effect as in the aforementioned embodiment.

Moreover, although the intake pipe absolute pressure PBA is used as the parameter indicative of engine load, it may be replaced by throttle valve opening $\theta$th, intake air quantity, or other parameters.

As described above, according to the present invention, the accelerating fuel increment TACC set to a value correspondent to the valve opening speed $\Delta\theta n$ of the throttle valve 3' is corrected by the detected value of a parameter indicative of the engine load. It is therefore possible to set the accelerating fuel increment TACC to a value optimal for the engine load condition, to thereby produce excellent effects such as improved accelerability and improved emission characteristics of the engine, and prevention of after-fire.

What is claimed is:

1. In a method of controlling the fuel supply to an internal combustion engine at acceleration, wherein a basic value of a quantity of fuel to be supplied to the engine is set in response to at least a parameter other than a throttle valve opening representative of load on the engine, and the set basic value is increased by the use of an accelerating fuel increment which is set in response to the valve opening speed of a throttle valve arranged in an intake passage of the engine and the rotational speed of the engine which are detected at the moment the state of acceleration of the engine is detected, the improvement comprising the steps of:

(1) detecting the value of said parameter representative of load on the engine when the engine is accelerating, said load being variable depending on opening modes of said throttle valve; and (2) correcting said accelerating fuel increment to a smaller value when the parameter value detected at said step (1) is smaller than a predetermined value.

2. A method as claimed in claim 1 wherein said step (2) is executed at every generation of a trigger signal, the method including: (a) detecting the value of a parameter indicative of acceleration of the engine; (b) determining whether or not the engine was operating in an accelerating condition at generation of a last pulse of said trigger signal; and (c) when it is determined that the engine was not operating in the accelerating condition at said step (b), (c-i) determining that the engine is detected in the acceleration condition at generation of a present pulse of said trigger signal when the value of said parameter indicative of acceleration of the engine is larger than a first predetermined value, and executing said step (2); and (c-ii) determining that the engine is operating in the accelerating condition when the detected value of said parameter is larger than a second predetermined value smaller than said first predetermined value at every generation of a subsequent pulse of said trigger signal, and executing said step (2).

3. A method as claimed in claim 1 wherein said parameter representative of the engine load is absolute pressure within the intake passage downstream of the throttle valve.

4. A method as claimed in claim 1 including the steps of detecting whether or not the engine is operating in a predetermined accelerating condition, counting the number of pulses of a control signal generated at predetermined crank angles of the engine after it is detected for the first time that the engine is operating in said predetermined accelerating condition, and setting said accelerating fuel increment in response to the counted number of said control signal pulses, as well as to the parameter value detected at said step (1) and the valve opening speed of said throttle valve, wherein a quantity of fuel increased by said accelerating fuel increment is injected into the engine in synchronism with generation of pulses of said control signal, when the engine is detected to be operating in said predetermined accelerating condition.

5. In a method of controlling the fuel supply to an internal combustion engine at acceleration, wherein a basic value of a quantity of fuel to be supplied to the engine is set in response to at least a parameter other than a throttle valve opening representative of load on the engine, and the set basic valve is corrected to an increased value by the use of an accelerating fuel increment which is set to a value corresponding to the valve opening speed of a throttle valve in an intake passage of the engine and the rotational speed of the engine which are detected at the moment the state of acceleration of the engine is detected, the improvement comprising the steps of:

(1) detecting the value of said parameter representative of load on the engine when the engine is accelerating, said load being variable depending on opening modes of said throttle valve; and (2) correcting said set value of said accelerating fuel increment to a smaller value when the parameter value detected at said step (1) is smaller than a predetermined value.

6. A method as claimed in any of claims 1, 2, 3, 4 or 5, wherein said opening modes of said throttle valve comprise ultimate opening values of said throttle valve at acceleration of the engine.

* * * * *